United States Patent [19]

Lantz et al.

[11] Patent Number: 4,856,785

[45] Date of Patent: Aug. 15, 1989

[54] OPTICAL DUAL FUNCTION JOYSTICK

[75] Inventors: Kenneth F. Lantz, Chicago; Walter E. Smolucha, Melrose Park; Leslie G. Struck, Arlington Heights, all of Ill.

[73] Assignee: Williams Electronics, Inc., Chicago, Ill.

[21] Appl. No.: 471,026

[22] Filed: Mar. 1, 1983

[51] Int. Cl.[4] ..... A63B 71/04

[52] U.S. Cl. ..... 273/148 B; 250/221

[58] Field of Search ..... 250/211 K, 221, 229; 273/1 E, 85 G, DIG. 28

[56] References Cited

U.S. PATENT DOCUMENTS

| | | | |
|---|---|---|---|
| 3,478,220 | 11/1969 | Milroy | 250/221 |
| 3,814,199 | 6/1974 | Jones | 250/229 |
| 4,092,532 | 5/1978 | Hayes | 250/221 |
| 4,250,378 | 2/1981 | Mutton | 250/221 |
| 4,349,735 | 9/1982 | Maeda | 250/229 |

*Primary Examiner*—Maryann Lastova

*Attorney, Agent, or Firm*—William T. Rifkin; Keith V. Rockey; Stanley M. Parmerte

[57] ABSTRACT

A joystick actuator for controlling the positioning of objects, for instance, displays on CRTs, having a pivotally mounted control stick operatively engaging and driving a pair of optical-mask members. The optical-mask members are retained for rectilinear sliding motion relative to fixed mounted opto-switches and include spaced fins positioned to interrupt light communication within respective opto-switches. Positioning of the opto-switches and spacing of the mask fins are selected to provide successive unblocking of the interrupted light communication as the control column is displaced from neutral thereby encoding both the direction and magnitude of stick deflection.

7 Claims, 2 Drawing Sheets

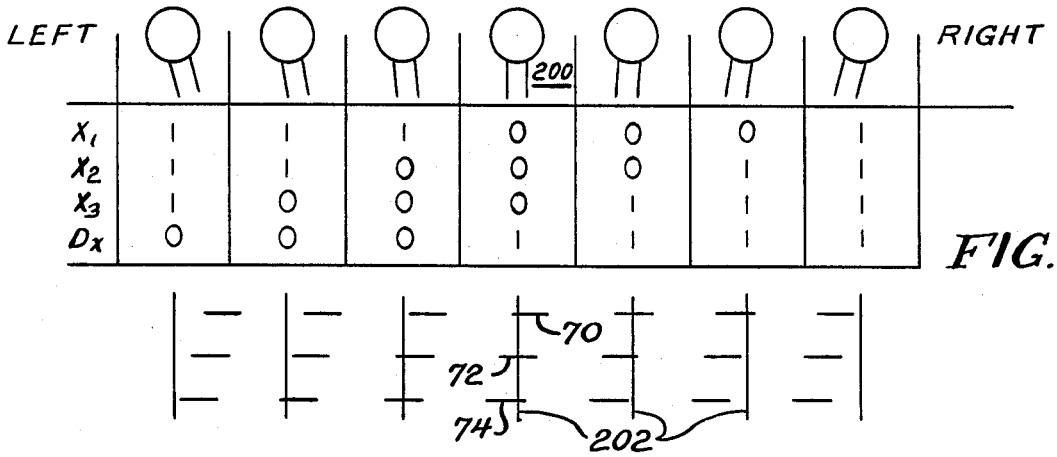
FIG. 3
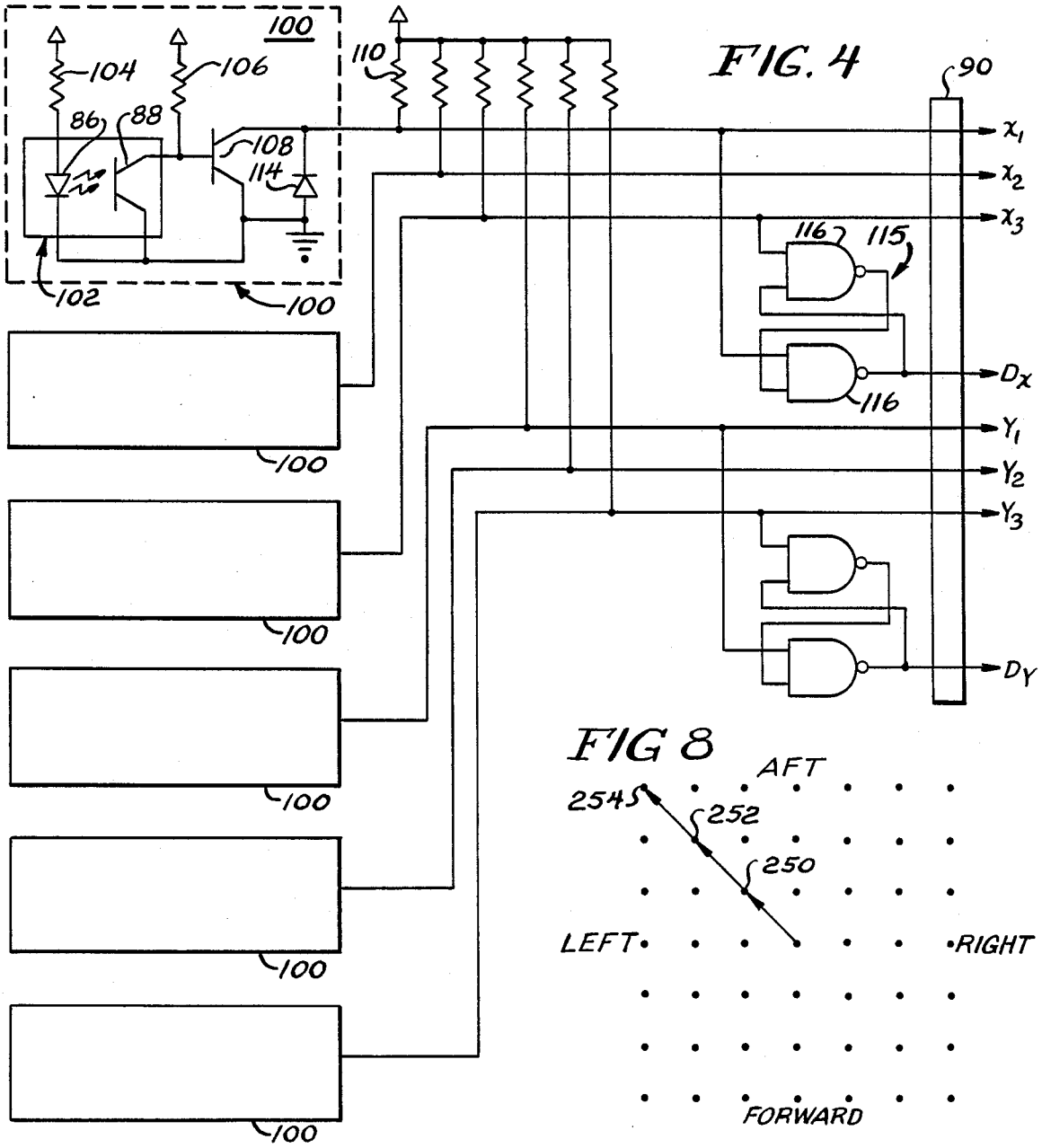
FIG. 4
FIG 8

OPTICAL DUAL FUNCTION JOYSTICK

BACKGROUND OF THE INVENTION

The present invention relates to control switches or actuators, in particular, to an optical sensing 'joystick' wherein optical mask members selectively block opto-switch light communication in predetermined relationship to joystick position thereby providing a digital output representative thereof.

Joysticks are well known to the art and are particularly suited to control or direct movement of a device or symbol in two dimensions. In the video game field, for example, joysticks have been utilized to provide control input to the game enabling a player to direct movement of game symbols two-dimensionally across a conventional TV-type display screen.

Common joysticks utilize a plurality of switches, spaced generally in uniform fashion around the axis of the joystick control shaft, to register the displacement of the control stick in various predetermined directions. Generally four such switches, corresponding to the cardinal directions, are employed to detect a gross stick deflection in one of these directions or, where two adjacent switches are actuated simultaneously, at an angle therebetween. Simple joysticks of this type, although of limited initial cost, provide only gross directional control and include no deflection magnitude information whatsoever. As the respective directional switch is either closed or open, movement of the controlled object is necessarily restricted to a predetermined fixed velocity in the selected direction. This limited joystick capability is unacceptable for more complex systems where greater directional control and control over object velocity are required.

One solution includes the addition of a second actuator which controls the velocity of movement of an object in the direction selected by the joystick. This solution requires multiple control switch or actuator assemblies and, more importantly, generally requires two-handed operation. The joystick of the present invention, by contrast, provides for velocity as well as enhanced directional control in a single one-hand control.

Joysticks having combined direction and displacement encoding capability may be found within the art. Known examples included Bennett et al, U.S. Pat. No. 3,770,915; Hoke, U.S. Pat. No. 4,052,578; and Burson, U.S. Pat. No. 4,161,726. The above devices, however, are mechanically complex, and therefore too costly for some applications, for instance, the game market, and include mechanical displacement detection means subject to wear and consequent malfunction. It is known, that joysticks used in many applications are generally subject to extreme, rapid, and repeated control stick movements which can result in the premature failure of mechanical displacement detection means. For example, both Bennett '915 and Burson '726 utilize mechanical brushes or fingers adapted to engage metalized contacts on a surface moved in relation thereto. Both the brushes and contacts are prone to excessive wear and damage when subjected to the continuous harsh usage characteristic of the game environment. Hoke '578 utilizes a multi-cam arrangement to engage associated switches. Again, mechanical switch failure following prolonged harsh usage combined with the expense and complexity of the multiple cam and switch mechanism renders this device unattractive in the game market.

The instant joystick, by contrast, utilizes a novel optical-mask arrangement loosely retained for sliding motion and adapted to optically 'switch' fixed mounted opto-switches. There are no critical sliding mechanical contacting surface or other mechanical switches such as found in the above patents. Nor is direct mechanical engagement or contact between respective moving and stationary joystick members required.

It is, therefore, an object of the present invention to provide a joystick that may be manufactured at reasonable cost as required for the game and other industries and is suited to use in harsh environments. The joystick preferably utilizes opto-switches to avoid mechanical actuating engagement and mechanical switches. Further, optical-mask members having fins thereon shall be retained for sliding movement with respect to the opto-switches. The switches and fins are spaced to provide discrete output codes uniquely corresponding to the displacement of the control column.

FIG. 3 is a graphic illustration and table interrelating control column positions, optical mask fin positions, and switch output codes;

FIG. 4 is a schematic diagram of the opto-switch and direction detect circuitry;

FIG. 8 is a graphic representation of the forty-nine output codes of a six opto-switch (3 per axis) joystick.

DESCRIPTION OF PREFERRED EMBODIMENT

Figure 1:
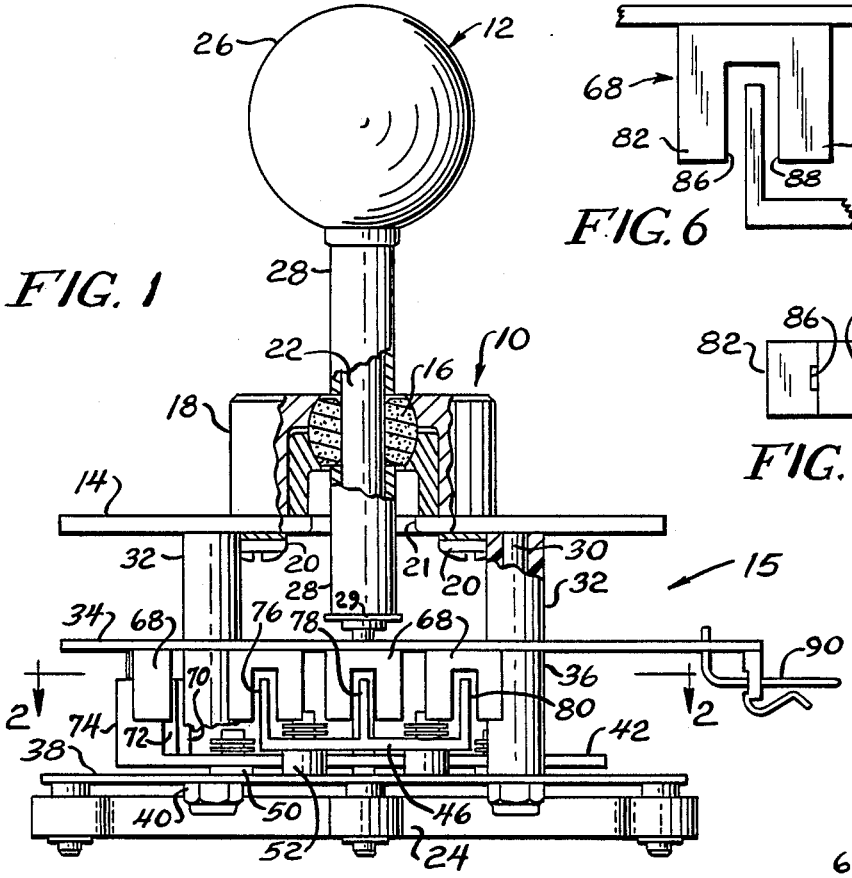
FIG. 1 is a side elevation view of the joystick of this invention with portions broken away to reveal hidden portions.

The 'joystick' of this invention, shown generally at 10 of FIG. 1, includes a control column or stick 12 retained for pivotal movement on, and extending through, a mounting plate 14 into engagement with unique control stick displacement sensing apparatus 15 secured to the bottom of plate 14. A plurality of mounting holes (not shown) are spaced about the perimeter of plate 14 to facilitate attachment of the instant joystick to the chassis or housing of a game or the like.

Control stick 12 is retained for pivotal or swivel movement within hub 18 by means of swivel bearing 16 therein. Hub 18 is secured to plate 14 by screws 20. An opening 21 is provided in plate 14 through which stick 12 extends thereby permitting its engagement with the displacement sensing apparatus 15 below plate 14. The diameter of this opening defines and limits the maximum displacement of control stick 12 and may be selected to effect the desired maximum stick travel.

Control stick 12 comprises a metal shaft 22 which extends the length of the overall assembly from the bottom or rearward region where it engages an elastic stick centering member 24, upwardly past displacement sensing circuitry, through plate 14 and swivel bearing 16, to knob 26 rigidly secured to the uppermost end of shaft 22. Bushings or spacers 28 along shaft 22 properly position the shaft within bearing 16 and "O" ring 29 precludes axial travel of the shaft within this bearing.

The displacement sensing apparatus 15, including printed circuit board 34 and opto mask slides 42, 46, is secured by four studs 30 staked to plate 14 and extending downwardly therefrom. A first set of spacers 32 position printed circuit board 34 in fixed parallel relationship below plate 14 while a second set of spacers 36 similarly positions slide guide plate 38 in parallel relationship below printed circuit board 34. Nuts 40 on studs 30 retain the above members in fixed position as described.

The joystick displacement sensing assembly of this invention includes means for independently detecting the degree of control stick movement from its centered or neutral position in graduated steps in each of two orthogonal directions. Thus, first displacement sensing apparatus responds to the left-right movement of the stick (relative to its centered or neutral position) while second displacement sensing apparatus registers forward-aft stick travel. As will be explained in further detail below, by combining the output or signals from these independent and orthogonal displacement sensors, complex control stick motions can be detected including the direction as well as the magnitude of such stick movements.

Figure 2:
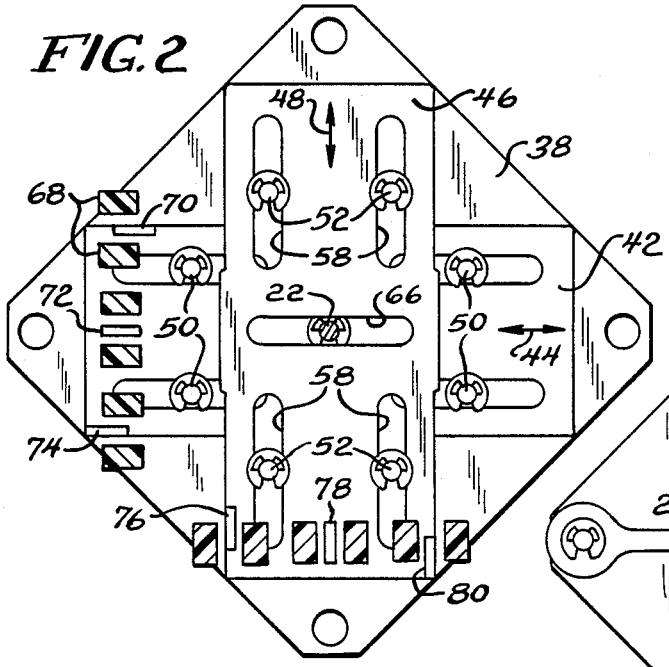
FIG. 2 is a sectional view along line 2-2 showing the opto-slides and fins in the neutral stick position.
Figure 5:
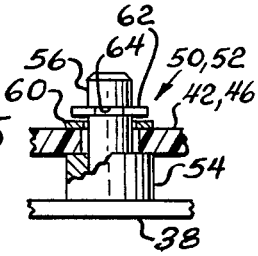
FIG. 5 is a fragmentary view with portions broken away showing an optical-mask slide retained on a mounting stud.
Figure 9:
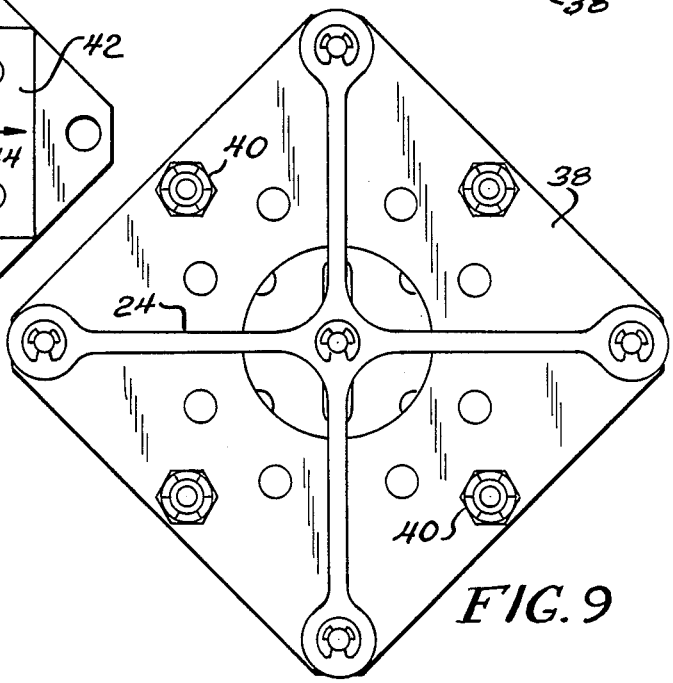
FIG. 9 is a bottom view of the instant joystick showing the optical-mask slide mounting plate and stick centering elastic member.

The displacement sensing apparatus of this invention, as best shown in FIGS. 1 and 2, includes a lower opto mask slide 42 mounted for left-right movement as illustrated by arrow 44 and an upper opto mask slide 46 mounted for forward-aft motion as shown by arrow 48. More particularly, each slide includes four slots 58 adapted to receive corresponding spaced posts 50, 52 staked to slide plate 38. As shown in FIG. 5, posts 50, 52 include shank portions 54 adapted to space the slides predetermined distances from plate 38 and stud portions 56 adapted to protrude through slots 58 and slidably retain slides 42, 46 for reciprocal movement along respective orthogonal 'left-right' and 'fore-aft' axes. Washers 60 and 'C'-shaped rings 62 within annular recesses 64 on studs 56 provide the required sliding attachment of slides 42, 46. Shanks 54 of the upper slide posts 52 are longer than corresponding shanks of lower slide posts 50 to facilitate the non-interfering and independent retention of upper slide 46 above lower slide 42.

Each opto-mask slide is further provided with a fifth or drive slot 66 substantially in the center thereof but oriented transverse to its direction of slide travel. Control column shaft 22 extends through these slots and is adapted to independently urge mask slides 42, 46 into rectilinear motion as defined by slots 58 when a component of the applied control stick force acts perpendicularly to the respective drive slot 66. Conversely, shaft 22 merely traverses slot 66, causing no movement of the slide, when the control stick force is directed along the axis of the respective drive slot. In this manner, each opto-mask slide is responsive to control column movements along a single axis, which axis corresponds to the axis of non-movement of the other opto slide.

It will be appreciated, however, that although movement of control stick 12 may result in the movement of only one of the slides 42, 46; more generally, a displacement of the control stick may include components along both slide axes and therefore cause movement of both slides. Thus, the joystick of this invention defines and resolves complex stick displacements into a sum of two orthogonal and independent motions. This is discussed in more detail below.

Opto-mask slides 42, 46 include a plurality of perpendicular spaced members or fins extending upwardly therefrom which function to selectively block optical communication within opto switches 68. The embodiment of FIGS. 1 and 2 includes three 'staggered' fins 70, 72, 74 on one end of lower slide 42 and similarly, three staggered fins 76, 78, 80 on the upper slide 46. The fins on lower slide 42 are longer than corresponding fins on upper slide 46 to azssure that all fins will properly extend into opto-switches 68 to effect the requisite optical blocking.

Figure 6:
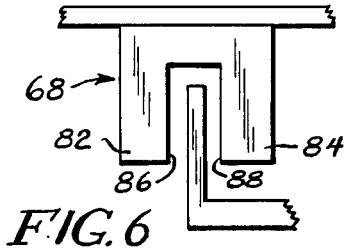
FIG. 6 is a fragmentary side view showing an opto-switch having an optical-mask fin positioned therein.
Figure 7:
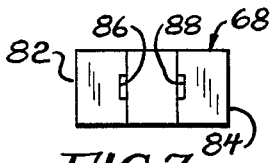
FIG. 7 is a bottom view of an opto-switch showing the light emitting source and photo detector.

An opto-switch 68 associated with each slide fin is mounted on printed circuit board 34. For the embodiment depicted in FIGS. 1 and 2, a total of six opto-switches 68 are required. As best shown in FIGS. 6 and 7, and the schematic of FIG. 4, opto-switches 68 are generally U-shaped and each comprises a transmitter arm 82 and a receiver arm 84. A light emitting diode 86 in the transmitter arm directs a beam of infra-red light to a corresponding photo transistor 88 in the receiver arm. Light from diode 86 striking phototransistor 88 causes this transistor to 'turn-on' or eletrically conduct. However, when a slide fin is positioned within the switch thereby blocking optical communication therethrough, phototransistor 88 'turns-off' and becomes electrically non-conductive.

Each opto-switch 68 is connected by appropriate and identical circuitry 100 to a connector 90 as shown in FIG. 4. Opto-switches 68 are represented schematically at 102 and include, as previously indicated, light emitting diodes 86 and phototransistors 88. A resistor 104 connected to a voltage source (not shown) limits the current through diode 86 as necessary for proper diode illumination. Bias resistors 106 provide base drive current to common-emitter inverting amplifier transistors 108 enabling these transistors to 'turn-on'. An output pull-up resistor 110 from the voltage supply to each output line 112 forces these lines to a 'high' or logic '1' level when transistor 108 is off. Diodes 114 from the output lines to ground clamp these lines precluding negative voltage spikes which might otherwise damage logic gates connected thereto.

In operation, light from diode 86 striking phototransistor 88 causes this transistor to turn-on which, in turn, shunts the bias current of resistor 106 to ground thereby 'turning-off' inverting transistor 108. With transistor 108 in the 'off' or non-conducting state, pull-up resistor 110 forces the corresponding output line to a logical "1" output. When the light communication path between diode 86 and phototransistor 88 is blocked by one of the slide fins, phototransistor 88 'turns-off' or becomes non-conductive thereby allowing the current through bias resistor 106 to switch inverting transistor 108 'on' which, in turn, forces the corresponding output line to a logical '0' state. In this manner the logical state of output lines 112 are switched to reflect the position of slides 42, 46 with optical blocking fins thereon.

Referring again to FIGS. 1 and 2 and, in particular, to left-right slide 42 with fins 70, 72, and 74 thereon, it can be seen that the associated opto-switches 68 are aligned side-by-side in such relationship that the respective paths of light communication within each switch 68 lie in a common line substantially transverse to the direction of slide 42 travel. Further, in the neutral or centered 'stick' position shown in FIG. 2, the fins of slide 42 block communication of all three opto-switches thereby resulting in logical '0' outputs from left-right output pins $X_1$, $X_2$, and $X_3$, as shown by the center column 200 of FIG. 3.

The truth table of FIG. 3 illustrates the logical outputs from the three left-right optical sensing circuits 100 and from the left-right direction circuit 115, discussed below, as the control stick is displaced from its neutral or centered position indicated at 200. Also depicted in FIG. 3 are relative control stick and slide fin positions corresponding to each of the given truth table outputs. Thus, the relative stick position is illustrated within the column immediately above the corresponding truth table entry while the fins of slide 42 are shown directly below the entry. Lines 202 represent the optical axes of switches 68. It will be appreciated that a logical '0' is shown in the corresponding truth table entry whenever a slide fin 70, 72, or 74 intersects the optical axis thereby blocking light communication.

Due to the staggered positioning of the fins on slide 42, movement of the stick and slide from the neutral position, successively removes the fins from blocking optical engagement within opto-switches 68. Leftward displacement of the control stick results in a logical "1" appearing at outputs $X_1$, $X_2$, and $X_3$, as fins 70, 72, and 74, in that order, unblock corresponding opto-switches. Thus, the left-right output ($X_1$, $X_2$, $X_3$) encodes the progressive leftward movement of the stick into the codes (1,0,0), (1,1,0), and (1,1,1). Rightward movement of the stick similarly causes the successive unblocking of the opto-switches. However, in this direction the order is reversed with fin 74 and output $X_3$ responding first. The output codes ($X_1$, $X_2$, $X_3$) corresponding to the rightward movement of the control stick are (0,0,1), (0,1,1), and (1,1,1).

It can be seen that a unique output code ($X_1$, $X_2$, $X_3$) is generated for each discrete position of the control stick except that full left and full right stick deflections both produce output code (1,1,1). To overcome this ambiguity, a direction detect circuit 115 is connected as a fourth output or direction line $D_x$. Direction circuit 115 is a bi-stable flip-flop comprising a pair of cross-coupled NAND gates 116 and having respective inputs connected to output lines $X_1$ and $X_3$. The state of flip-flop 115 and of output $D_x$ when both flip-flop inputs $X_1$ and $X_3$ are high or logical '1' (i.e. when the stick is either full right or full left) is determined by which input $X_1$ or $X_3$ was the last to attain the logical '1' condition. If the stick is deflected to the left, $X_3$ is the last output to go 'high' thereby forcing output $D_x$ to the logical '0' state. On the other hand, full rightward deflection of the control stick results in $X_1$ remaining low longer thereby forcing output $D_x$ into the logical '1' state. In this manner, the four left-right output lines uniquely define seven discrete control stick positions.

It will be appreciated that any number of optical sensors are contemplated by this invention to achieve any desirable gradiations of stick position. For example, two opto-switch sensors permit encoding of five discrete stick positions while the addition of a fourth opto-switch facilitates up to nine encoded positions. The structure and operation of the joystick of this invention in the forward-aft or 'Y' direction is identical to that just described except for the difference in fin size considered previously.

As discussed above, the 'staggering' of the slide fins is required to assure the sequential switching of each of the X and Y output lines thereby generating a series of output codes uniquely corresponding to discrete control stick positions. It will be understood, however, that opto-switches 68 could similarly be staggered, along or in combination with staggered fins, to achieve the desired sequential 'unblocking' of the opto-switches. In short, any arrangement of fins and opto-switches which results in the sequential operation of switches as the control stick is displaced is contemplated by this invention.

In certain situations it may be advantageous to provide a nonlinear control stick gradient having, for example, increased sensitivity near stick dead-center. This can be accomplished by varying the incremental stick displacements defined between adjacent pairs of output codes. Such a non-linear response can be achieved utilizing the teachings of the instant invention by appropriately 'staggering' the fins or opto-switches and/or by selecting slide fins of appropriate width.

A preferred use of the instant joystick is a microprocessor based video game or the like wherein the outputs are periodically read and interpreted by the microprocessor. While an understanding of the specific game format and associated software are not considered important to an understanding of this invention, it will be appreciated that the coded multi-position joystick disclosed herein facilitates substantially improved and more flexible player control over game symbols and play. In one game, for example, a cursor or game symbol may be moved in direct corresponding relation to the stick position whereby each encoded output defines a unique symbol position location within the game display. More commonly, however, movement of the stick defines the direction of travel of a game symbol with the new position at any given future moment being, in part, a function the symbol's previous location. The joystick of this invention is particularly suited for such player interactive games since the multi-encoded opto-switch outputs permit the definition of both the direction and magnitude of any stick displacement. Thus, the instant joystick may be utilized out only to control the direction of game symbol movement but, additionally, the displacement magnitude feature may be employed to define the velocity of such movement increasing, for example, as the stick is displaced further from the centered position.

As explained above, the orthogonally disposed slides 42, 46, and associated displacement sensing apparatus function independently thereby defining each control stick position or movement as the complex or vector sum of these individual orthogonal outputs. FIG. 8 represents a map of possible output combinations for the joystick depicted and described herein. Since each of the seven left-right outputs may, at any instant, be paired with any of the seven forward-aft outputs, a total of forty-nine unique control stick outputs or positions are thereby defined.

Each of these positions further corresponds to, and defines, a particular control stick displacement and direction. For example, the three outputs 250, 252, and 254 of FIG. 8 all represent control stick movements rearwardly and to the left at a forty-five degree angle, but, respectively representing increasing control stick deflections. The game processor may, therefore, by programmed to effect movement of a game symbol along an identical 45° path in response to each of these outputs and, additionally, to define the velocity of such movement corresponding to the magnitude of such stick deflection. Thus, the velocity of movement may be increased as the control stick is positioned successively at 250, 252, 254.

I claim:

1. A joystick control apparatus having a control column retained for pivotal movement on a mounting member and a column position detection means operatively coupled to the column adapted to generate a unique output corresponding to predetermined control column positions; the improvement comprising optical position detection means including a plurality of optical switches and means remote from said switches for selectively actuating the switches, means for supporting the switch actuating means for rectilinear reciprocal sliding motion on the mounting member whereby the optical switches are actuated without direct mechanical contact.

2. A joystick control apparatus having a control column retained for pivotal movement on a mounting member and control column position detection means operatively coupled to the column adapted to generate a unique output corresponding to predetermined control column positions within a given plane; the improvement comprising optical position detection means including a plurality of optical switches, each switch having spaced light source and light detection means defining a light communication path therebetween, said path of light communication being oriented substantially perpendicular to said given plane, means for securing the optical switches in fixed relationship to the mounting member; and including optical-mask means retained for slidable reciprocal motion on the mounting member, the axis of motion being within the plane and substantially perpendicular to the control column axis at its mid or neutral position, the control column operatively engaging the optical mask means urging the reciprocal motion of the mask means along its axis, the optical mask means having means for blocking the light communication path whereby movement of the control column causes the sequential blocking and unblocking of the opto-switch light paths thereby generating switch output codes uniquely corresponding to control column position.

3. A joystick control apparatus including a frame member; an elongated control column having a first handle end and a second end to operatively engage column position sensing means; means for retaining and securing the control column between the first and second ends to the frame member for pivotal movement thereon; control column position sensing means including first and second optical mask means; means for securing the optical mask means to the frame member for reciprocal sliding movement thereon, the axis of movement of the first mask means being disposed at a rigid angle to the axis of movement of the second mask means; means in said mask means for receiving the second end of the control column and for urging movement of the respective mask means responsive only to control column displacements along the respective axes of mask means; a plurality of optical switches operatively associated with each optical mask means, each switch including a light source and a light detector defining a light communication path therebetween, blocking of the communication path causing the switch to change its output condition; means for securing the switches associated with the first optical mask means to the frame whereby the axes of the light communication paths are substantially perpendicular to the axis of travel of the first mask means; a plurality of means on the first mask means adapted to block the light communication paths of the first mask switches, each such blocking means adapted to block light communication only at predetermined control column positions; means for securing the switches associated with the second optical means to the frame whereby the axes of the light communication paths are substantially perpendicular to the axis of travel of the second mask means; a plurality of means on the second mask means adapted to block the light communication paths of the second mask switches, each such blocking means adapted to block light communication only at predetermined control column positions, whereby movement of the control column in any direction causes said switches to uniquely define the direction and displacement of the control column.

4. The joystick control apparatus of claim 3 wherein the axes of light communication of the plurality of switches associated with each mask means coincide and wherein the plurality of means for blocking light communication on each mask means are spaced along the axis of the respective mask means whereby movement of the mask means causes the sequential blocking of the individual switch communication paths thereby providing a coded switch output uniquely corresponding to the position of the control column.

5. The joystick control apparatus of claim 3 wherein the size and spacing of the plurality of means for blocking light communication on each mask means are selected so that movement of the control column and mask means causes only one switch communication path to be blocked or unblocked at a time wherein any two adjacent control column positions along a given optical mask axis is defined by switch output codes differing by at most one switch condition.

6. The joystick control apparatus of claim 3 wherein the axes of light communication of the plurality of switches associated with each mask means are spaced along the axis of the optical mask means thereby facilitating generation of switch output codes uniquely corresponding to the position of the control column.

7. The joystick control apparatus of claim 3 in which full control column deflection in both directions along a given optical mask axis causes all corresponding switch outputs to assume the same condition; means for detecting the direction of movement of the control column thereby uniquely defining the position of the control column.

* * * * *